US009059514B2

(12) United States Patent
Sanford et al.

(10) Patent No.: US 9,059,514 B2
(45) Date of Patent: Jun. 16, 2015

(54) STRUCTURES FOR SHIELDING AND MOUNTING COMPONENTS IN ELECTRONIC DEVICES

(75) Inventors: Emery A. Sanford, San Francisco, CA (US); Qingxiang Li, Mountain View, CA (US); Lijun Zhang, San Jose, CA (US); Anthony S. Montevirgen, San Francisco, CA (US); Teodor Dabov, San Francisco, CA (US); Erik G. P. de Jong, San Francisco, CA (US); Wey-Jiun Lin, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 229 days.

(21) Appl. No.: 13/524,997

(22) Filed: Jun. 15, 2012

(65) Prior Publication Data

US 2013/0335275 A1 Dec. 19, 2013

Related U.S. Application Data

(60) Provisional application No. 61/652,796, filed on May 29, 2012.

(51) Int. Cl.

| | |
|---|---|
| ***H01Q 1/24*** | (2006.01) |
| ***H01Q 1/42*** | (2006.01) |
| ***H01Q 1/38*** | (2006.01) |

(52) U.S. Cl.

CPC ..... *H01Q 1/42* (2013.01); *Y10T 29/49016* (2015.01); *H01Q 1/243* (2013.01); *H01Q 1/38* (2013.01)

(58) Field of Classification Search

CPC ..... H01Q 1/243; H01Q 1/38

USPC ..... 343/702, 841, 878

See application file for complete search history.

(56) References Cited

U.S. PATENT DOCUMENTS

| | | | | |
|---|---|---|---|---|
| 6,791,827 | B2 * | 9/2004 | Kuo | 361/679.26 |
| 7,847,753 | B2 | 12/2010 | Ishibashi et al. | |
| 7,889,139 | B2 * | 2/2011 | Hobson et al. | 343/702 |
| 8,059,039 | B2 | 11/2011 | Ayala Vazquez et al. | |
| 8,269,677 | B2 * | 9/2012 | Guterman et al. | 343/702 |
| 8,551,672 | B2 * | 10/2013 | Wang Chen | 429/510 |
| 2009/0159412 | A1 * | 6/2009 | Liu et al. | 200/302.3 |
| 2011/0050509 | A1 * | 3/2011 | Ayala Vazquez et al. | 343/702 |
| 2011/0212288 | A1 | 9/2011 | McClure et al. | |
| 2012/0087065 | A1 | 4/2012 | Kim et al. | |

* cited by examiner

*Primary Examiner* — Tho G Phan

(74) *Attorney, Agent, or Firm* — Treyz Law Group; G. Victor Treyz; Joseph F. Guihan

(57) ABSTRACT

An electronic device may be provided with a conductive housing. An antenna window structure may be formed in an opening in the housing. The antenna window structure may have an antenna support structure that is attached to the conductive housing and that supports antenna structures. An antenna window cap may be mounted in the opening and attached to the antenna support structure with liquid adhesive. Alignment structures may be provided in the antenna support structure. An antenna support plate with mating alignment structures may be used in attaching the antenna structures to the antenna support structures. Metal shielding structures may be used to provide electromagnetic shielding. A shielding wall may be formed from a sheet metal structure supported by a plastic support structure. A flexible metal shielding foil layer may be welded to the shielding wall using a sacrificial plate.

27 Claims, 14 Drawing Sheets

STRUCTURES FOR SHIELDING AND MOUNTING COMPONENTS IN ELECTRONIC DEVICES

This application claims the benefit of provisional patent application No. 61/652,796, filed May 29, 2012, which is hereby incorporated by reference herein in its entirety.

BACKGROUND

This relates to electronic devices and, more particularly, to antenna structures and electromagnetic shielding structures for electronic devices.

Electronic devices often contain wireless circuitry. For example, cellular telephone transceiver circuitry and wireless local area network circuitry may be provided to allow a device to wirelessly communicate with external equipment. Antenna structures may be used in transmitting and receiving wireless signals.

Devices may also contain displays and other circuits that may interfere with wireless circuitry. To properly ground antenna structures and to provide electromagnetic shielding to reduce the impact of potentially harmful electromagnetic interference, it may be desired to incorporate electromagnetic shielding structures in an electronic device. Care should be taken, however, to avoid structures that are unnecessarily bulky, that provide unsatisfactory grounding, or that provide inadequate suppression of electromagnetic interference.

It would therefore be desirable to be able to provide improved structures for mounting antennas in electronic devices and providing electromagnetic shielding.

SUMMARY

An electronic device may be provided with a conductive housing. An antenna window structure may be formed in an opening in the housing. The antenna window structure may have an antenna support structure that is attached to the conductive housing. Antenna structures such as antenna structures formed from traces on a printed circuit may be mounted on the antenna support structure. An antenna window cap may be mounted in the opening of the conductive housing. The antenna window cap may be attached to the antenna support structure with liquid adhesive that allows the antenna window cap to lie flush with an exterior surface of the conductive housing during adhesive curing operations, thereby improving flushness.

Alignment structures may be provided in the antenna support structure. An antenna support plate with mating alignment structures may be used in attaching the antenna structures to the antenna support structures. Ribs on the antenna support structure may serve as alignment features that bear against corresponding rib-shaped alignment features on the conductive housing.

Metal shielding structures may be used to provide electromagnetic shielding in the electronic device. Shielding walls may be formed from sheet metal structures supported by a plastic support structure. End portions of the shielding walls may be embedded within the plastic support structure during an insert molding process.

A flexible shielding layer formed from a thin metal sheet may be welded to a shielding wall. The thin metal sheet may have a thickness of less than 20 microns. To prevent damage during welding, a sacrificial plate may be incorporated into the welded structure. Conductive structures such as springs on printed circuits and conductive foam may be used in connecting shielding structures to a conductive electronic device housing.

Further features of the invention, its nature and various advantages will be more apparent from the accompanying drawings and the following detailed description of the preferred embodiments.

DETAILED DESCRIPTION

Electronic devices often contain circuitry that is subject to potential electromagnetic interference effects. To suppress electromagnetic interference, it may be desirable to provide an electronic device with metal structures that serve as electromagnetic shields. The metal structures may be used to short conductive structures together. For example, metal structures may be used to provide a grounding path for an antenna. Metal structures may be interposed between circuits that handle potentially interfering signals. For example, the metal structures may be used to form a shield layer between a potential source of interference such as a display driver circuit in a display and a potential victim device such as an antenna.

Metal structures that may be used for shorting structures in a device together, that may be used for antenna grounding, and that may form walls and other structure that reduce electromagnetic interference may sometimes be referred to herein as shielding structures or electromagnetic interference shielding structures. Metal structures such as these may be formed from stamped sheet metal parts, from flexible metal foil, or from other conductive structures. These metal structures may be used for grounding antennas or other wireless components, may be used to prevent electromagnetic signals in one portion of a device from reaching another portion of a device, may be used to short metal structures together such as metal housing structures, or may otherwise be used in managing electrical signals in an electronic device.

An antenna in an electronic device may be mounted under an antenna window structure. For example, an electronic device may have a metal housing with an opening to accommodate antenna signals. The opening may be filled with a dielectric material such as plastic. The plastic may be configured to form an antenna window cap that floats within the opening. Adhesive may be used to attach the antenna cap to an internal structure such as an antenna support structure using adhesive. A fixture may be used to ensure that the antenna window cap structure and adjacent portions of the metal housing are flush before curing the adhesive. The adhesive may be a liquid adhesive having a thickness than can vary to accommodate variations in the sizes of the antenna window structures while maintaining flushness of the antenna window cap to the housing.

Figure 1:
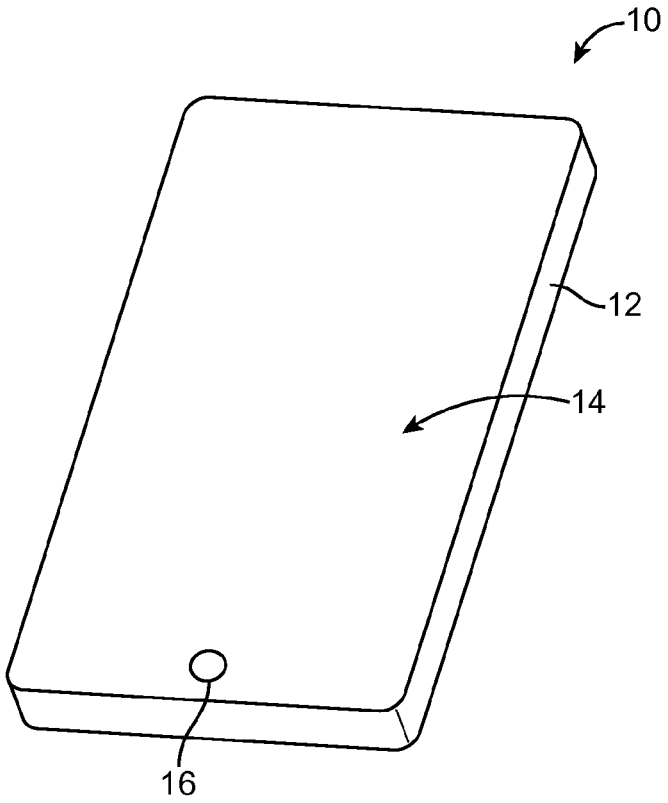
FIG. 1 is a front perspective view of an illustrative electronic device of the type that may contain mounting, grounding, and shielding structures in accordance with an embodiment of the present invention.

An illustrative device of the type that may include antenna window structures and electromagnetic shielding structures such as these is shown in FIG. 1. As shown in FIG. 1, electronic device 10 may include a display such as display 14. Display 14 may be a touch screen that incorporates a layer of conductive capacitive touch sensor electrodes or other touch sensor components or may be a display that is not touch-sensitive. Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. Configurations in which display 14 includes display layers that form liquid crystal display (LCD) pixels may sometimes be described herein as an example. This is, however, merely illustrative. Display 14 may include display pixels formed using any suitable type of display technology.

Display 14 may be protected using a display cover layer such as a layer of transparent glass or clear plastic. Openings may be formed in the display cover layer. For example, an opening may be formed in the display cover layer to accommodate a button such as button 16.

Device 10 may have a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.). The periphery of housing 12 may, if desired, include walls. For example, housing 12 may have a peripheral conductive member such as a metal housing sidewall member that runs around some or all of the periphery of device 10 or may have a display bezel that surrounds display 14. Housing 12 may have sidewalls that are curved, sidewalls that are planar, sidewalls that have a combination of curved and flat sections, sidewalls that extend upwards from an integral rear housing surface, and sidewalls of other suitable shapes. One or more openings may be formed in housing 12 to accommodate connector ports, buttons, and other components.

Figure 2:
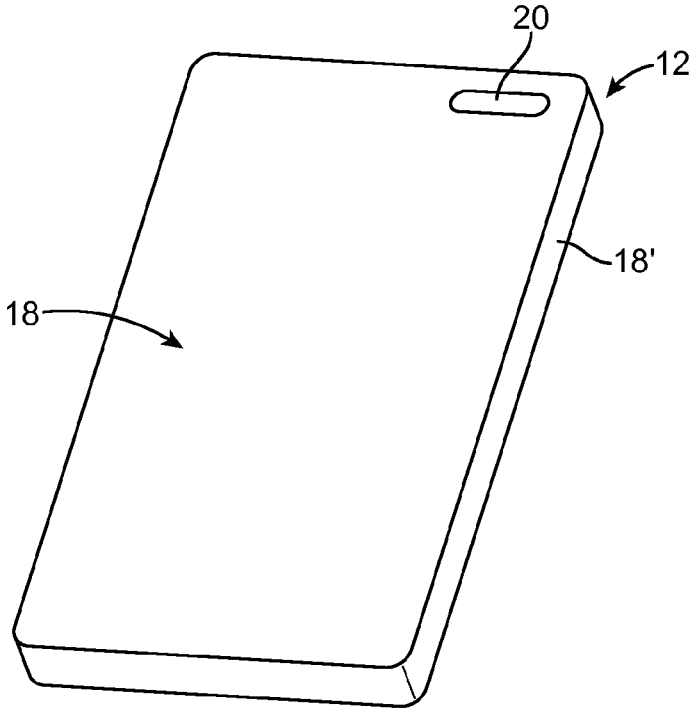
FIG. 2 is a rear perspective view of the electronic device of FIG. 1 in accordance with an embodiment of the present invention.

As shown in the front perspective view of FIG. 1, display 14 may be mounted on the front face of device 10. As shown in the rear perspective view of FIG. 2, device 10 may have a rear housing member such as rear planar housing wall 18. Wall 18 may be formed from a planar plastic structure, a planar metal structure, a glass layer, ceramics, or other materials. As an example, wall 18 and sidewalls 18' may form integral portions of housing 12 and may be formed from aluminum, stainless steel, or other metals. Openings may be formed in rear wall surface 18. For example, an opening may be formed in rear wall surface 18 of housing 12 (and, if desired, sidewalls 18') to accommodate antenna window 20. The structures for antenna window 20 may be formed from glass, ceramic, polymer (plastic) or other suitable dielectric materials. As an example, antenna window 20 may be formed from a plastic such as polycarbonate (PC), acrylonitrile butadiene styrene (ABS), or a PC/ABS blend (as examples).

Figure 3:
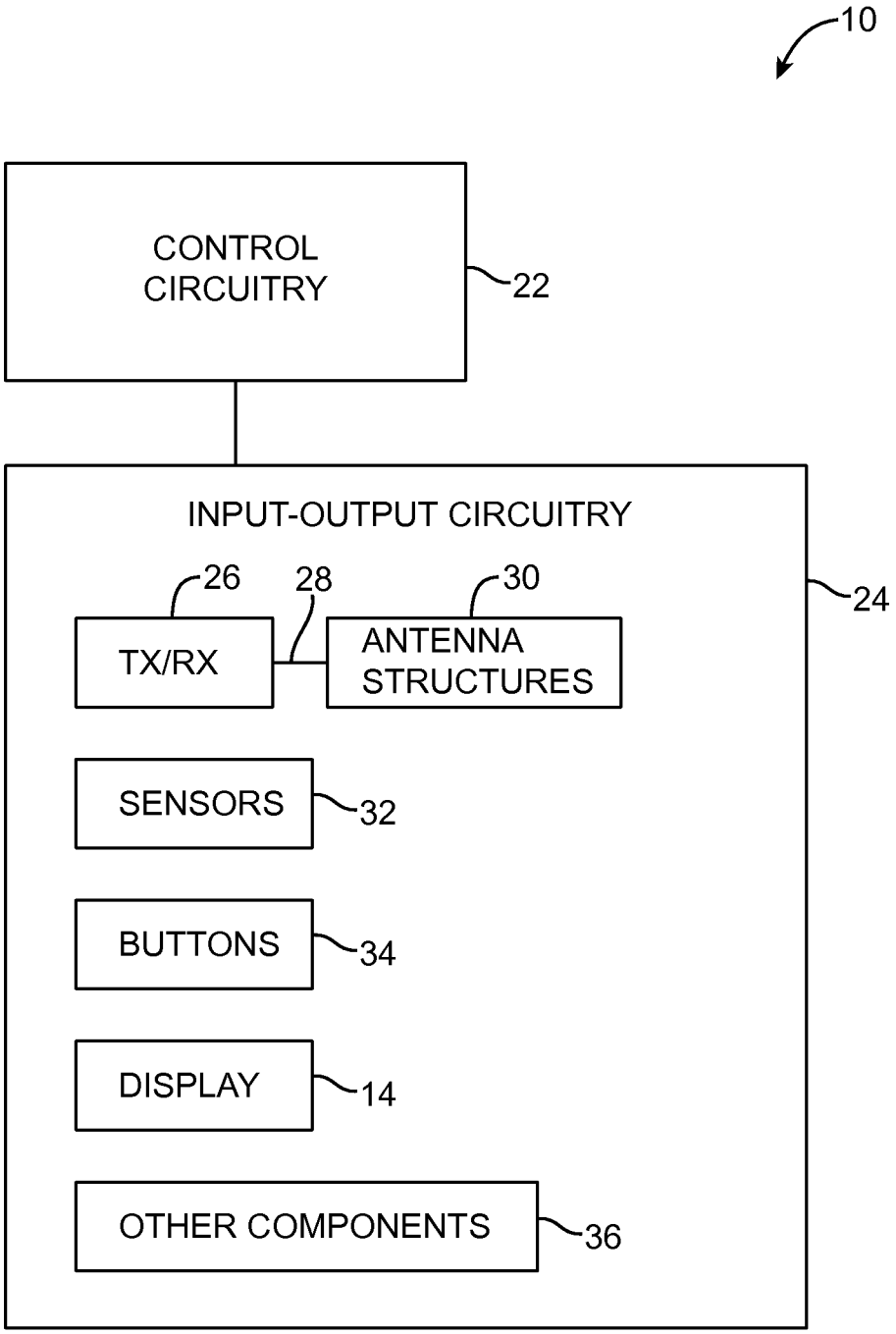
FIG. 3 is a schematic diagram of an illustrative electronic device in accordance with an embodiment of the present invention.

A schematic diagram of an illustrative configuration that may be used for electronic device 10 is shown in FIG. 3. As shown in FIG. 3, electronic device 10 may include control circuitry 22 and input-output circuitry 24. Control circuitry 22 may include storage and processing circuitry that is configured to execute software that controls the operation of device 10. Control circuitry 22 may be implemented using one or more integrated circuits such as microprocessors, application specific integrated circuits, memory, and other storage and processing circuitry.

Input-output circuitry 24 may include components for receiving input from external equipment and for supplying output. For example, input-output circuitry 24 may include user interface components for providing a user of device 10 with output and for gathering input from a user. As shown in FIG. 3, input-output circuitry 24 may include wireless circuitry such as radio-frequency transceiver 26. Radio-frequency transceiver 26 may include a radio-frequency receiver and/or a radio-frequency transmitter. Radio-frequency transceiver circuitry 26 may be used to handle wireless signals in communications bands such as the 2.4 GHz and 5 GHz WiFi® bands, cellular telephone bands, and other wireless communications frequencies of interest.

Radio-frequency transceiver circuitry 26 may be coupled to one or more antennas in antenna structures 30 using one or more transmission lines such as radio-frequency transmission line 28. Transmission lines in device 10 may be formed from one or more segments of coaxial cable, flexible printed circuit transmission lines, microstrip transmission lines, or edge coupled transmission lines (as examples). Antenna structures 30 may include inverted-F antennas, patch antennas, loop antennas, monopoles, dipoles, or other suitable antennas.

Sensors 32 may include an ambient light sensor, a proximity sensor, touch sensors such as a touch sensor array for a display and/or touch buttons, pressure sensors, temperature sensors, accelerometers, gyroscopes, and other sensors.

Buttons 34 may include sliding switches, push buttons, menu buttons, buttons based on dome switches, keys on a keypad or keyboard, or other switch-based structures.

Display 14 may be a liquid crystal display, an organic light-emitting diode display, an electrophoretic display, an electrowetting display, a plasma display, or a display based on other display technologies.

Device 10 may also contain other components 36 (e.g., communications circuitry for wired communications, status indicator lights, vibrators, etc.).

Antennas may include conductive structures supported on one or more support structures. Metal housing structures such as internal or external housing structures may also be used in forming antenna structures. As an example, a metal housing in device 10 such as some or all of housing wall structures 12 may form an antenna ground structure for an antenna. Conductive materials such as metal may be supported on dielectric substrates such as injection-molded plastic carriers, glass or ceramic members, or other dielectrics. As an example, patterned metal traces for an antenna resonating element and/or parasitic antenna resonating element may be formed on printed circuit substrates. An antenna may be formed, for example, using metal traces on a printed circuit such as a rigid printed circuit board (e.g., fiberglass-filled epoxy) or a flexible printed circuit formed from a sheet of polyimide or other flexible polymer layers. Antenna structures that are formed on printed circuit substrates may be supported by support structures such as plastic support structures or other dielectric support structures.

Figure 4:
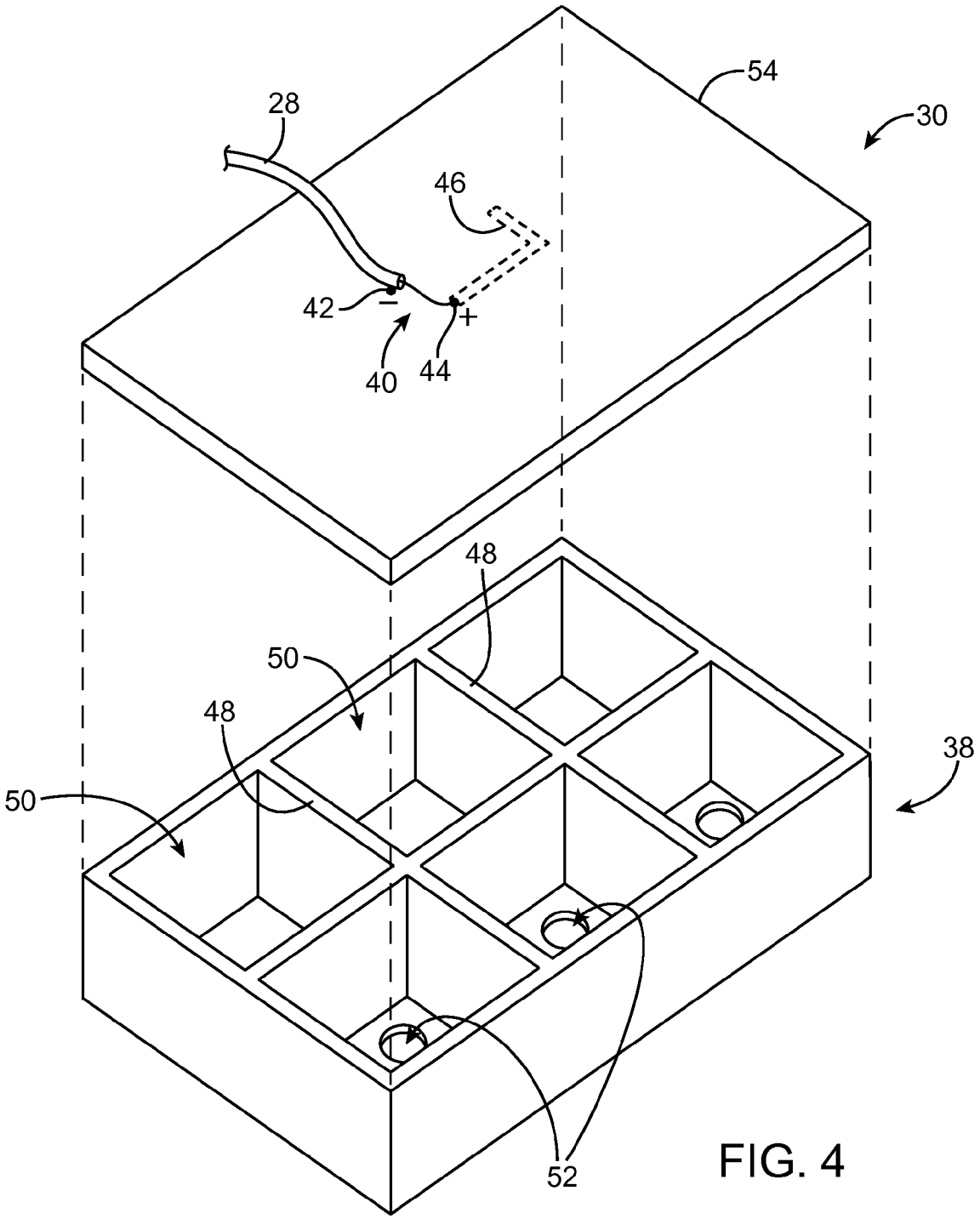
FIG. 4 is a perspective view of an illustrative antenna support structure and an associated flexible printed circuit antenna structure in accordance with an embodiment of the present invention.

Illustrative antenna structures for electronic device 10 are shown in FIG. 4. As shown in FIG. 4, antenna structures 30 may be supported using antenna support structures such as antenna support structure 38. Antenna structures 30 may be formed from a printed circuit substrate such as printed circuit 54. Printed circuit 54 may include patterned metal traces 46. Antenna structures 30 may form an antenna having an antenna feed such as antenna feed 40. Antenna feed 40 may have a positive antenna feed terminal such as feed terminal 44 and a ground antenna feed terminal such as ground feed terminal 42. Transmission line 28 (e.g., a coaxial cable) may have a positive center conductor that is coupled to terminal 44 and an outer braid ground conductor that is coupled to terminal 42 (as an example).

Antenna structures 30 may be mounted on antenna support structures 38 using adhesive, screws or other fasteners and may be mounted using interposed plastic plates and other support structures.

Antenna support structure 38 may be formed from a dielectric such as glass, ceramic, plastic, or other dielectric materials. As an example, antenna support structure 38 may be formed from one or more injection-molded plastic members such as plastic members formed from a plastic such as polycarbonate (PC), acrylonitrile butadiene styrene (ABS), or a PC/ABS blend.

Plastic structure 38 may include ribs 48 that separate the interior of structure 38 into air-filled cavities such as cavities 50. The use of air-filled cavities in structure 38 may help to lower the dielectric constant of support structure 38 and reduce antenna losses.

Support structure 38 may be provided with one or more openings such as openings 52. Openings (holes) 52 may be used during assembly of an antenna window structure such as antenna window structure 20 of FIG. 2 (as an example).

Figure 5:
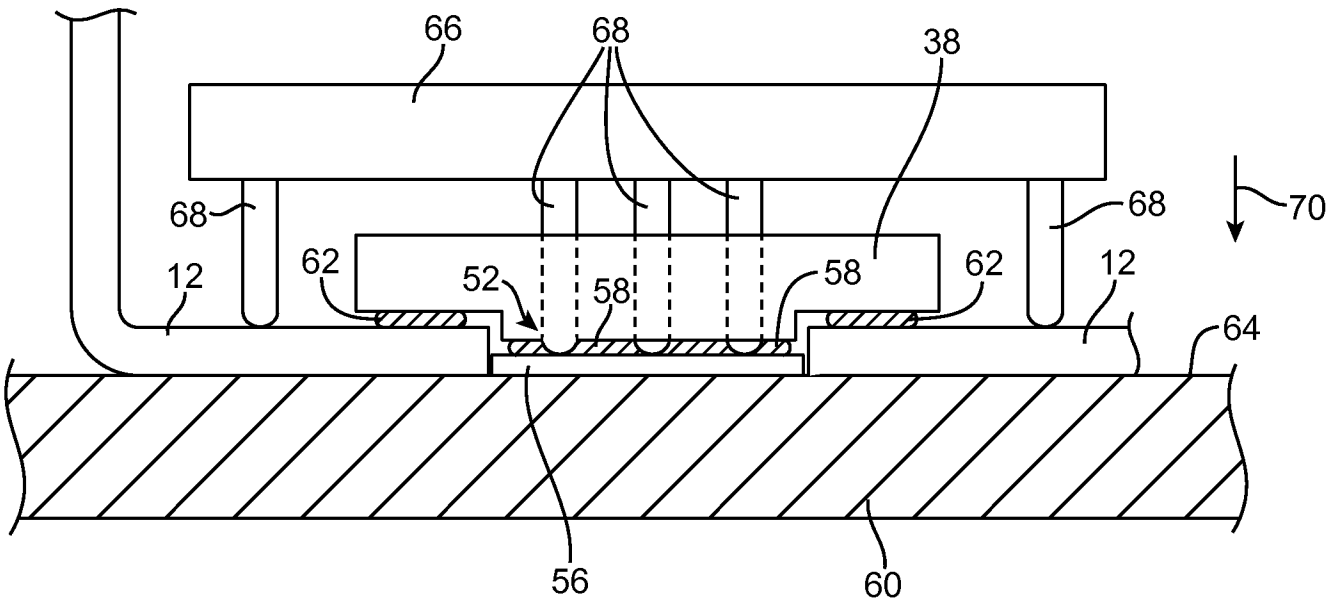
FIG. 5 is a cross-sectional side view of a portion of an electronic device in which a dielectric antenna window has been formed in accordance with an embodiment of the present invention.

As shown in the cross-sectional side view of FIG. 5, antenna window 26 of device 10 may be covered with a dielectric antenna window structure such as plastic antenna window cap structure 56 of FIG. 5 (sometimes referred to as an antenna window cap). Antenna window cap 56 may be formed from a plastic such as polycarbonate (PC), acrylonitrile butadiene styrene (ABS), or a PC/ABS blend (as examples).

Antenna support structure 38 may be attached to the interior of electronic device housing 12 using adhesive 62. Adhesive 62 may be, for example, pressure sensitive adhesive.

Antenna window cap 56 may be attached to antenna support structure 38 using cured liquid adhesive 58. Initially, adhesive 58 may be dispensed in liquid form, allowing antenna cap 56 to lie flush with housing 12 while absorbing size variations in support structure 38 and housing 12. During the curing process, the outer surface of antenna window cap 56 (i.e., the lowermost surface of antenna window cap 56 in FIG. 5) and the adjacent exterior surface of housing walls 12 (i.e., the lowermost housing surface in FIG. 5) may be supported by upper surface 64 of assembly tool structure 60. Structure 60 may be, for example, a metal tray or other structure that has a flat upper surface.

Biasing structures such as spring loaded pins 68 on assembly tool support 66 may press housing 12 and antenna window cap 56 downwards against surface 64 in direction 70. Holes 52 in antenna support structure 38 (see, e.g., holes 52 of FIG. 4) may allow pins 68 or other biasing members to pass through antenna support structure 38 to access the upper surface of antenna window cap 56. By simultaneously supporting antenna cap 56 and housing 12 using surface 64 while adhesive 58 is cured and thereby transformed from its uncured liquid state to a solid cured state, antenna cap 56 may be mounted flush with respect to housing 12.

Figure 6:
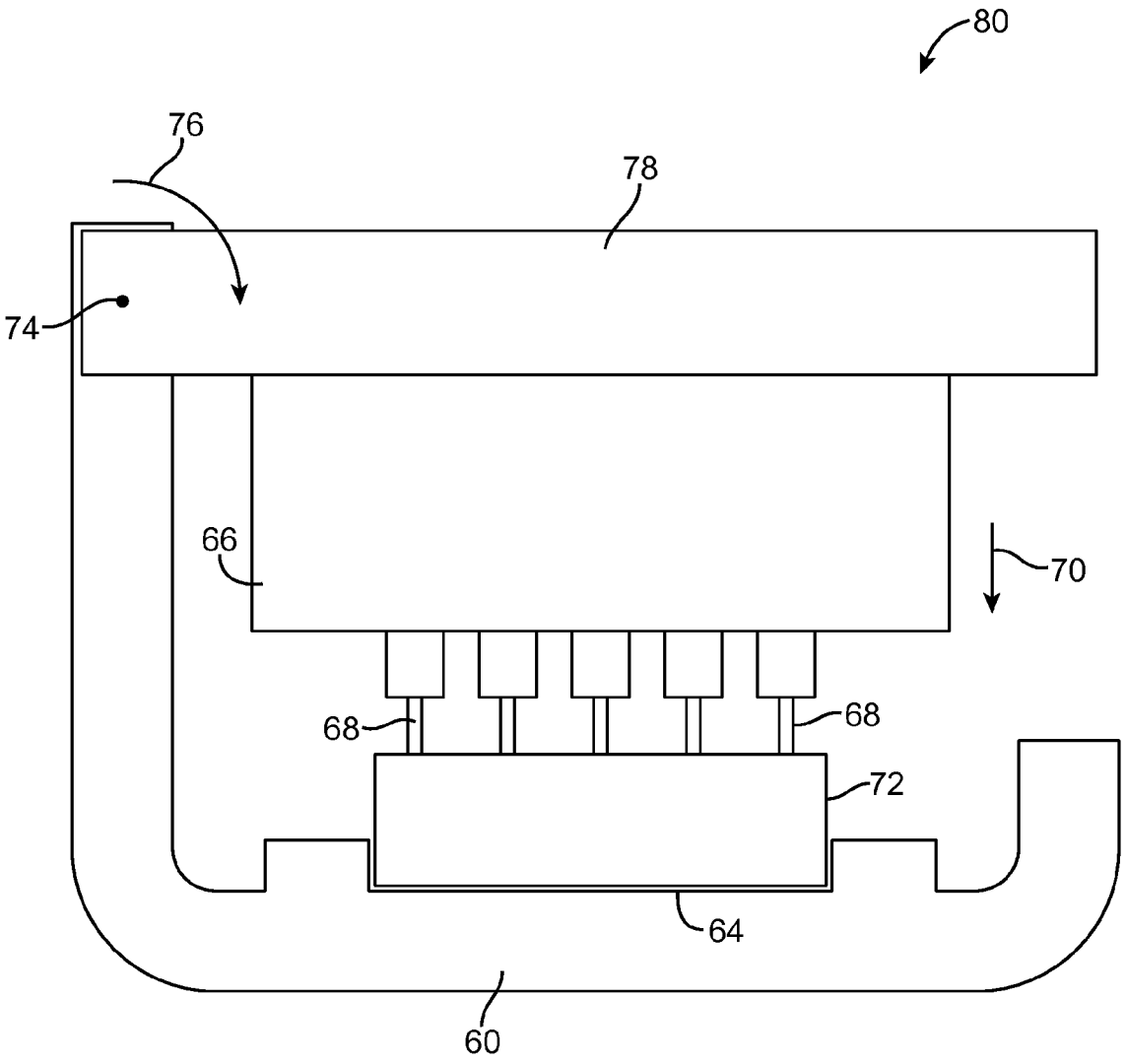
FIG. 6 is a side view of an illustrative fixture for holding electronic device structures of the type shown in FIG. 5 during liquid adhesive curing operations in accordance with an embodiment of the present invention.
Figure 7:
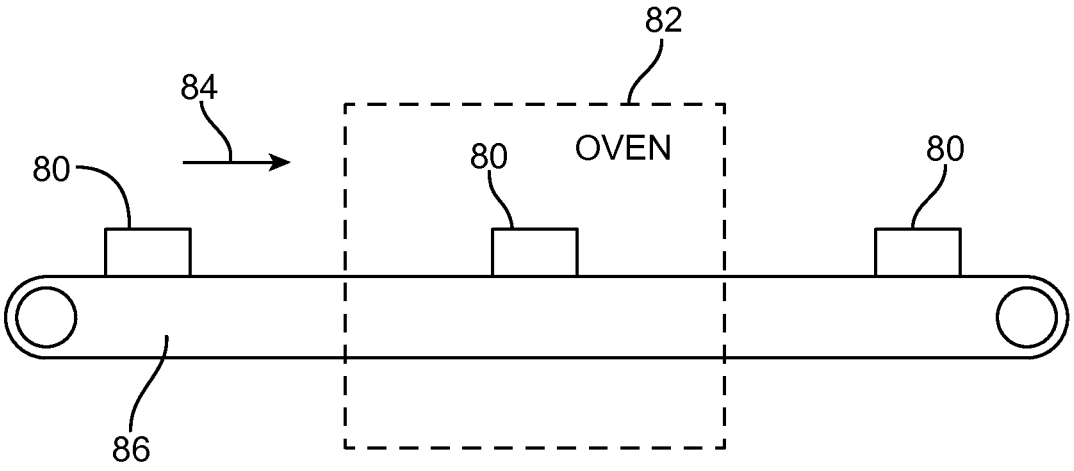
FIG. 7 is a cross-sectional side view of an illustrative conveyor belt system for conveying fixtures of the type shown in FIG. 6 through an oven to cure adhesive used in mounting an antenna window structure within an electronic device in accordance with an embodiment of the present invention.

As shown in FIG. 6, assembly tool support 66 and assembly tool structure 60 may form part of a curing tray such as tray 80. Support 66 may be mounted to spring-loaded arm 78. A spring or other biasing mechanism may be used to bias arm 78 and structure 66 downwards in direction 70 (e.g., by rotating arm 78 about pivot axis 74 in direction 76). Pins 68 may press downwards on assembly 72 (e.g., device structures such as housing wall 12 and antenna window cap 56 of FIG. 5) during adhesive curing. As shown in FIG. 7, tools such as tray 80 of FIG. 6 may be moved through an oven such as oven 82 using a positioner such as conveyor belt 86. As tray 80 moves through oven 82 or is otherwise exposed to heat, liquid adhesive 58 (FIG. 5) may be raised to an elevated temperature (e.g., 50-85° C., 75-85° C. or other suitable temperature) for sufficiently a long time (e.g., 10-30 minutes, less than 40 minutes, more than 20 minutes, etc.) to ensure that liquid adhesive 58 is cured. Once cured, liquid adhesive 58 attaches antenna window cap 56 to support structure 38, thereby fixing the position of antenna window cap 56 relative to device housing 12.

Figure 8:
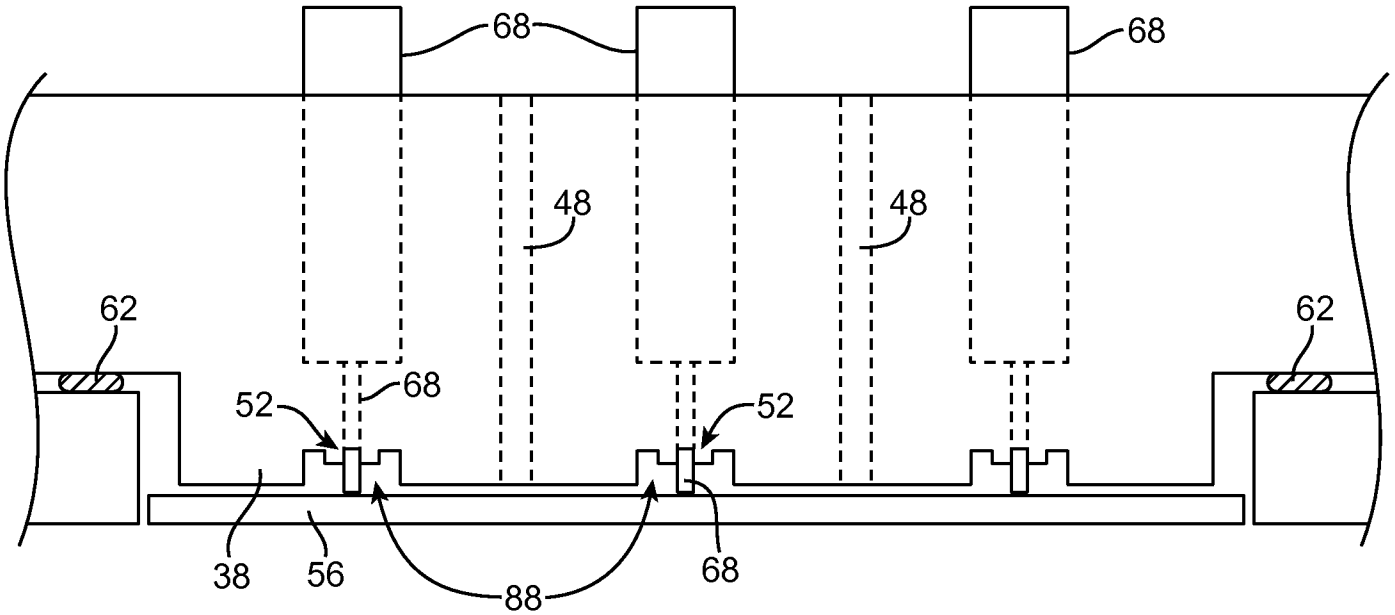
FIG. 8 is a cross-sectional side view of an illustrative system for holding an antenna window cap in a position that is flush with an electronic device housing during adhesive curing operations in accordance with an embodiment of the present invention.
Figure 9:
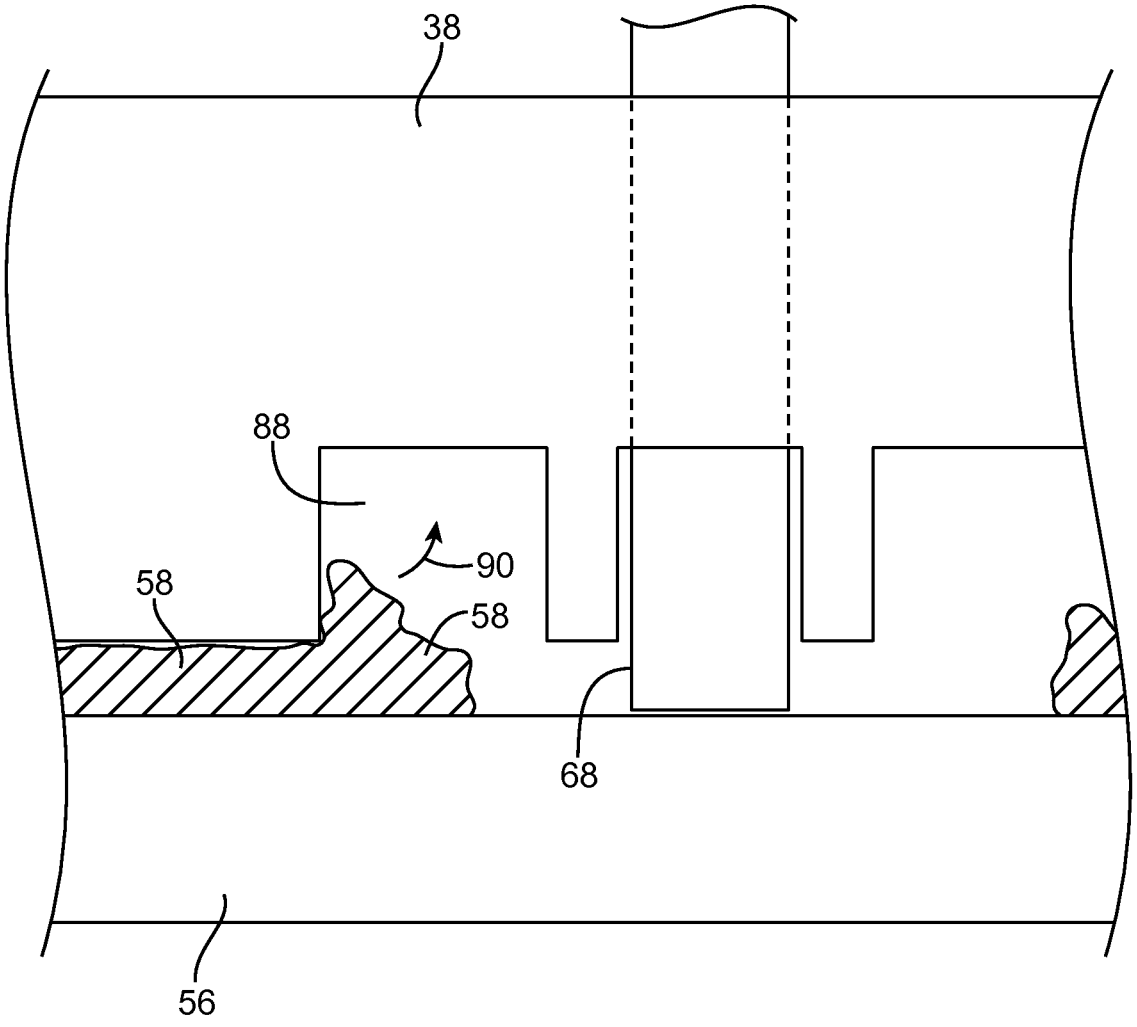
FIG. 9 is a side view of a portion of an illustrative antenna window structure and associated antenna support structure showing how the antenna support structure may have adhesive overflow channels in accordance with an embodiment of the present invention.

To prevent overflow of liquid adhesive 58 when attaching antenna window cap 56 to antenna support structure 38, antenna support structure 38 may be provided with adhesive overflow channels such as channels 88 of FIG. 8. Channels 88 may have the shapes of circular rings that surround holes 52 in support structures 38 or may have other shapes capable of receiving excess liquid adhesive. As shown in FIG. 9, excess adhesive 58 may flow upwards in direction 90 into the recess in support structure 38 that is formed by channel 88 during adhesive curing operations. Channels 88 may help prevent adhesive 58 from becoming attached to moving parts such as spring-loaded pin 68.

Figure 10:
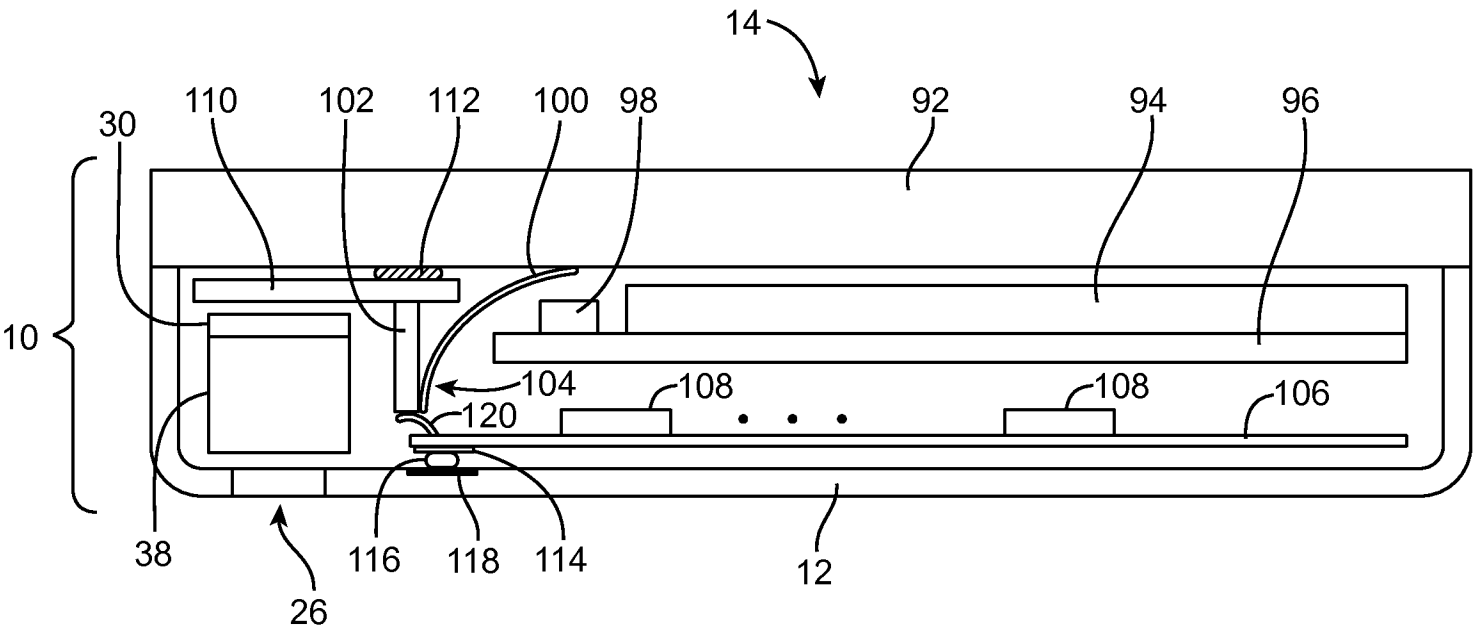
FIG. 10 is a cross-sectional side view of an electronic device showing how conductive foil structures may be used to provide antenna grounding and electromagnetic interference suppression in accordance with an embodiment of the present invention.

FIG. 10 is a cross-sectional side view of device 10 showing how structures in device 10 may be provided with electromagnetic shielding. As shown in FIG. 10, display 14 of device 10 may have a display cover layer such as layer 92. Layer 92 may be formed from clear glass, transparent plastic, or other suitable materials. An array of display pixels may be formed below cover layer 92. As shown in the example of FIG. 10, a display pixel array may be formed from layers such as thin-film transistor layer 96 and color filter layer 94. Layers 94 and 96 may form part of a liquid crystal display (as an example). Display driver integrated circuit 98 may be used in routing display control and data signals to thin-film transistors on thin-film transistor layer 96.

Printed circuits in device 10 such as printed circuit 106 (e.g., a main logic board or other printed circuit structures formed from one or more printed circuits) may receive components 108. Components 108 may be, for example, integrated circuits, switches, connectors, filters, discrete components, and other circuitry.

Wireless circuitry in device 10 such as antenna structures 30 may be sensitive to interference from components 108 and display driver circuitry 98. To reduce interference, conductive structures such as electromagnetic signal shield wall 102 and shield layer 100 may be used in forming electromagnetic shielding. As shown in FIG. 10, this shielding may be used to prevent signals from display driver circuitry such as display driver integrated circuit 98 and from components 108 from reaching antenna structures 30. Signals from antenna structures 30 or other components may also be prevented from reaching display driver circuitry 98 and other electrical components such as components 108.

Shield wall 102 may be formed from a metal such as stainless steel (as an example). Shield walls such as shield wall 102 may be patterned using a stamping die, laser cutting, or other patterning techniques. Shield walls such as wall 102 may be oriented vertically as shown in FIG. 10. As an example, walls such as wall 102 may be supported in a vertical orientation using plastic member 110. One or more shield walls may be oriented at right angles with respect to each other to surround a sensitive component (e.g., to shield an antenna in a corner of device 10). Shield walls such as wall 102 may, if desired, be attached to plastic member 110 by injection molding (insert molding) plastic member 110 over wall 102. Plastic member 110, which is sometimes referred to as a cover glass frame, may be attached to the inner surface of display cover layer 92 using adhesive 112. Adhesive 112 may be, for example, a methacrylate-based liquid adhesive. Adhesive 58 for attaching antenna window cap 56 may also be a methacrylate-based liquid adhesive (as an example).

To form an effective electromagnetic shield, it may be desirable to use shielding wall 102 to form a vertical wall of conductor that extends between display cover layer 92 and housing 12. As shown in FIG. 10, for example, shielding wall 102 may be coupled to housing 12 using spring 120, traces on printed circuit 106, a metal structure such as a connector on printed circuit 106 (e.g., connector 114), and conductive foam 116. Housing wall 12 may be formed from anodized aluminum or other metals. To ensure formation of a satisfactory low-resistance contact between foam 116 and housing wall 12, a portion of the anodization (aluminum oxide layer) on wall 12 may be removed by laser processing, thereby forming bare aluminum region 118. Conductive foam 116 or other resilient electrical connection structures may form an electrical contact between region 118 and metal structure 114 on printed circuit 106. If desired, other conductive pathways may be formed between shield wall 102 and housing wall 12. The configuration of FIG. 10 is merely illustrative.

Shield layers such as shield layer 100 of FIG. 10 may be formed from a thin layer of conductor such as a thin flexible layer of metal (i.e., a metal foil). To minimize the amount of volume occupied within the interior of device 10, it may be desirable to form shield layer 100 from a metal such as stainless steel that exhibits sufficient strength even at reduced thicknesses (e.g., thicknesses of less than 150 microns or even less than 20 microns). Stainless steel foil that is about 10 microns thick or other metal foils may be attached to metal structures in device 10 such as shield wall 102 using conductive adhesive, screws or other fasteners, using solder, or using welds. The use of welds may help to minimize contact resistance and thereby enhance the ability of shielding layer 100 and shielding wall 102 to form effective electromagnetic shielding within device 10.

Figure 11:
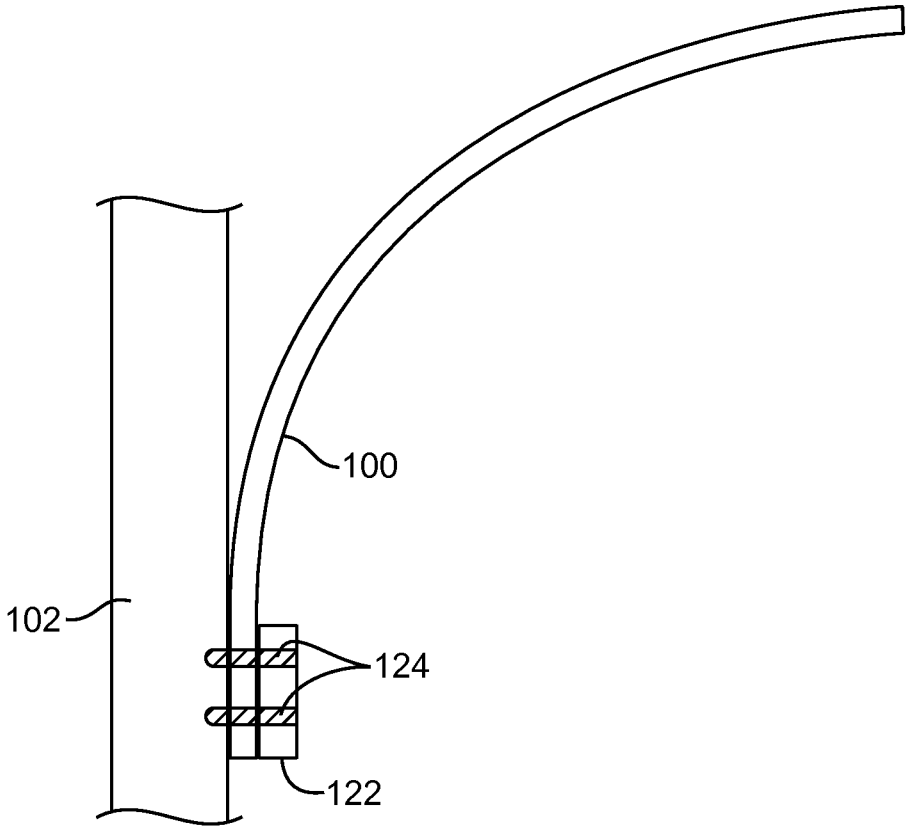
FIG. 11 is a cross-sectional side view of a portion of a conductive shielding wall and an associated welded metal foil layer in accordance with an embodiment of the present invention.

Shielding layer 100 may be formed from a sheet of stainless steel foil or other material that has a thickness of less than 150 microns, less than 100 microns, more than 70 microns, less than 70 microns, less than 40 microns, less than 20 microns, or less than 10 microns (as examples). To prevent tearing resulting from damage during welding, it may be desirable to use a sacrificial metal plate such as plate 122 of FIG. 11 in forming welds 124. To promote satisfactory welding, the metals used for wall 102, foil 100, and plate 122 may be formed from the same metal (e.g., stainless steel). Plate 122 may have a thickness that is sufficient to allow plate 122 to donate material to welds 124 during weld formation, thereby preventing layer 100 from being excessively thinned and weakened during welding. Plate 122 may, for example, have a thickness of 0.05 to 0.15 mm.

Figure 12:
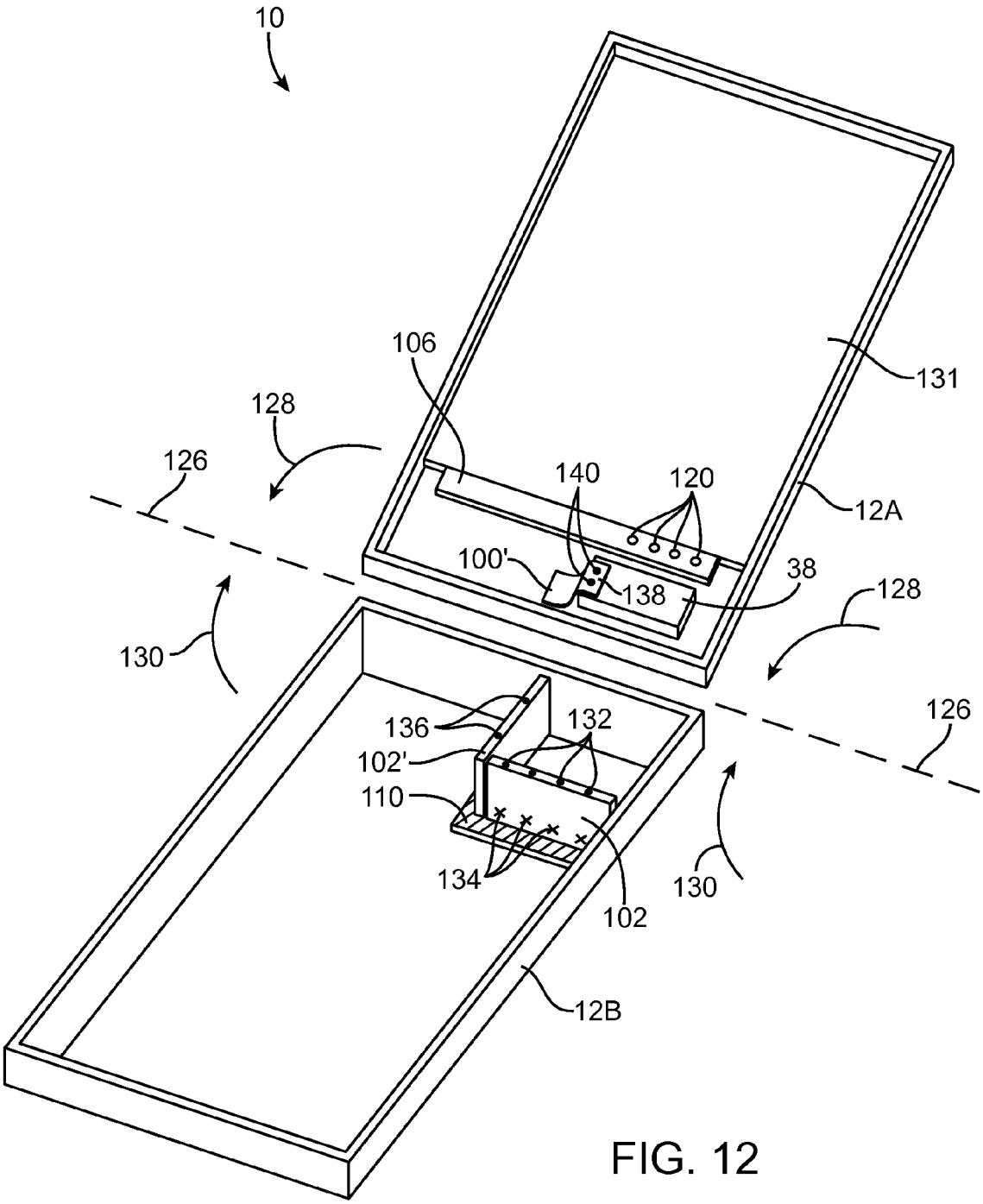
FIG. 12 is an exploded perspective view of an illustrative electronic device having conductive structures for antenna grounding and electromagnetic shielding in accordance with an embodiment of the present invention.

FIG. 12 is an exploded perspective view of device 10 in an illustrative configuration in which shielding structures are used to reduce electromagnetic interference. As shown in FIG. 12, device 10 may have housing portions such as housing portion 12A and housing portion 12B. In a completed device, housing portion 12A may be attached to housing portion 12B (e.g., by rotating housing 12A in direction 128 about rotational axis 126 and by rotating housing 12B in direction 130 around rotational axis 126).

As shown in FIG. 12, device 10 may have internal housing structures such as mid-plate member 131. An edge of printed circuit board 106 may protrude from under mid-plate 131. Springs 120 may be soldered to printed circuit board solder pads along the edge portion of printed circuit board 106. When housings 12A and 12B are assembled, springs 120 may mate with contact regions 132 on shielding wall 102. Welding locations 134 on wall 102 show where shield layer 100 (not shown in FIG. 12) may be attached to shield wall 102.

Shield walls 102 and 102' may run perpendicular to each other and may be supported by plastic support structure 110 (e.g., by insert molding walls 102 and 102' within the plastic of structure 110). Antenna support structure 38 may be provided with a metal structure such as jumper plate 138. Jumper plate 138 may be formed from a sheet of stainless steel or other metal and may be attached to support structure 38 using screws that pass through plate 138 and support structure 38 and that are received by threaded portions of housing 12A. A sheet of stainless steel or other metal layer may be used to form shielding layer 100'. Shielding layer 100' may, for example, be formed from the same type of thin metal that is used in forming shielding layer 100. When housings 12A and 12B are assembled, contact regions 140 on plate 138 may contact regions 136 on shield wall 102' (e.g., using interposed conductive foam).

Figure 13:
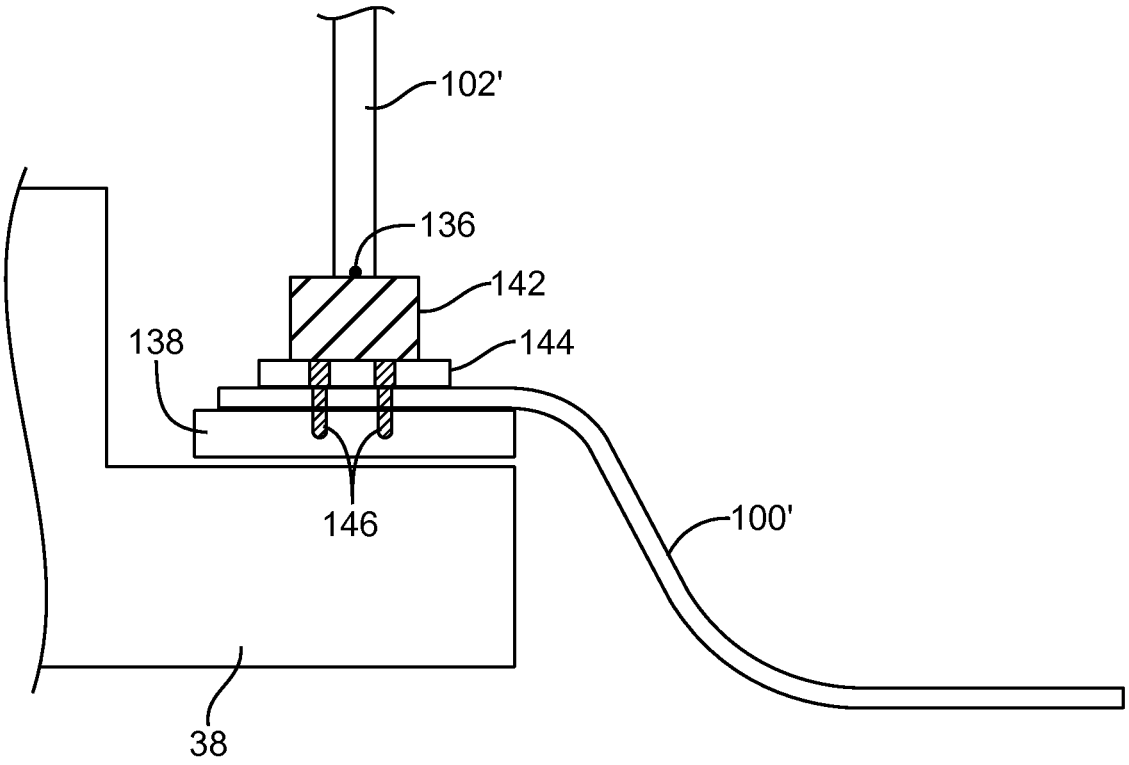
FIG. 13 is a cross-sectional side view of a portion of the conductive structures in FIG. 12 showing how a coupling structure such as conductive foam may be used to electrically connect shielding structures in accordance with an embodiment of the present invention.

FIG. 13 is a cross-sectional side view of shielding layer 102' showing how a sacrificial plate (e.g., a plate formed from a stainless steel sheet having a thickness of 0.05 to 0.15 mm) may be used in welding shield layer 102' to jumper plate 138. Conductive foam 142 may be interposed between shielding layer 102' and shield wall 102' to form an electrical connection between wall 102 and jumper plate 138. Jumper plate 138, in turn, may be electrically connected to housing 12A via screws or other conductive structures.

Figure 14:
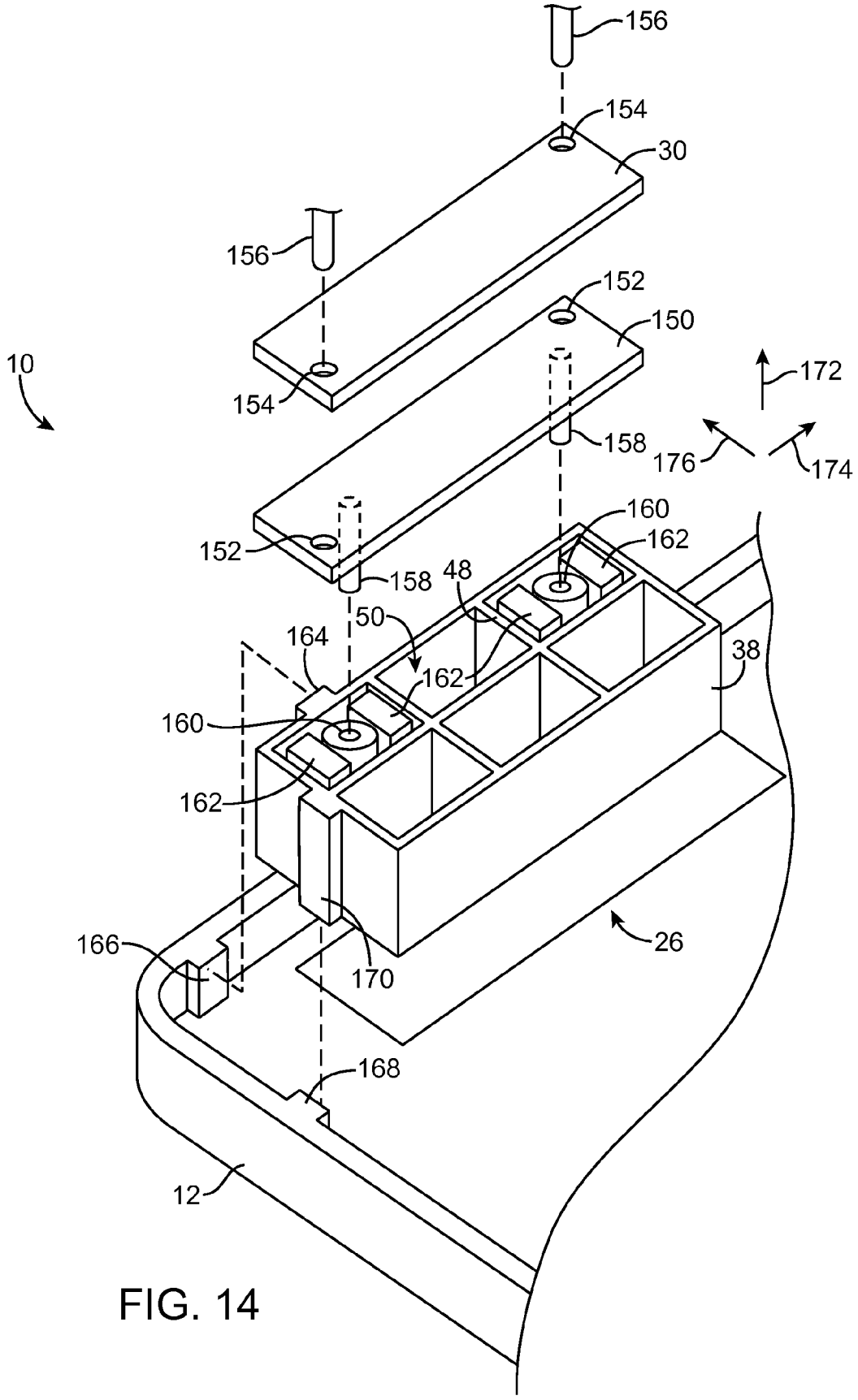
FIG. 14 is a perspective view of a corner portion of an electronic device having antenna structures in accordance with an embodiment of the present invention.

An exploded perspective view of a portion of device 10 showing how antenna structures 30 may be mounted to support structure 38 using a support plate is shown in FIG. 14. As shown in FIG. 14, housing 12 may have alignment features such as ribs 166 and 168 that are configured to mate with corresponding alignment features on support structures 38. When antenna support structure 38 is installed in housing 12 of device 10, rib 170 may rest against rib 168 of housing 12 and ribs such as rib 164 of support structure 38 may rest against ribs on housing 12 such as rib 166.

Support structure 38 may have alignment features such as alignment holes 160 that receive mating alignment features such as alignment posts 158 on antenna support plate 150 when antenna support plate 150 is mounted on top of antenna support structure 38. Biasing structures such as foam structures 162 may be used to bias plate 150 and antenna structures 30 upwards in direction 172 towards display cover layer 92 (FIG. 10). Antenna structures 30 (e.g., a flexible printed circuit containing antenna traces) may be mounted to an antenna support structure such as antenna support plate 150 using adhesive or other suitable attachment mechanisms. Plate 150 may help maintain antenna structures 30 in a desired shape. Due to the presence of alignment posts 158, plate 150 may help antenna structures 30 resist lateral motion in directions 174 and 176, thereby helping to ensure that antenna structures 30 are located where desired.

Figure 15:
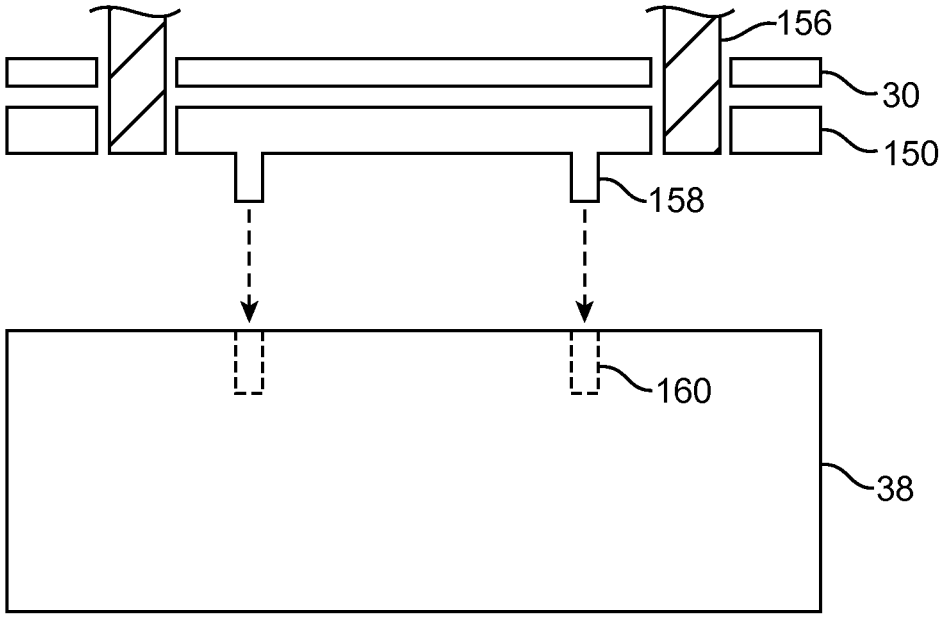
FIG. 15 is a cross-sectional side view of the antenna structures of FIG. 14 during assembly using support structures in accordance with an embodiment of the present invention.

During assembly operations, an alignment tool such as an alignment tool with alignment pins 156 may insert pins 156 through both holes 154 on antenna structures 30 and mating holes 152 on antenna support plate 150. This ensures that antenna structures 30 will be properly aligned with respect to antenna plate 150 along lateral dimensions 176 and 174. Adhesive or other suitable fastening mechanism may be used to attach antenna structures 30 to antenna support plate 150. FIG. 15 is a cross-sectional side view showing how alignment pins 156 may be used during assembly to ensure that antenna structures 30 are aligned with respect to antenna support plate 150. Protrusions such as antenna support plate alignment posts 158 or other alignment features may be used to ensure satisfactory alignment between antenna support plate 150 and antenna support structures 38. Following mounting of antenna support plate 150 to antenna structures 138, alignment members 156 may be removed. Display cover layer 92 may then be mounted on top of antenna structures 30.

The foregoing is merely illustrative of the principles of this invention and various modifications can be made by those skilled in the art without departing from the scope and spirit of the invention. The foregoing embodiments may be implemented individually or in any combination.

What is claimed is:

1. Apparatus, comprising:

an electronic device housing having a hole;

an antenna window cap in the hole;

an antenna support structure that is attached to the electronic device housing; and a layer of adhesive that attaches the antenna window cap to the antenna support structure.

2. The apparatus defined in claim 1 wherein the antenna support structure comprises at least one hole adjacent to the antenna window cap.

3. The apparatus defined in claim 2 wherein the antenna support structure comprises an adhesive overflow channel surrounding the hole.

4. The apparatus defined in claim 3, wherein the adhesive overflow channel surrounding the hole comprises a ring shaped overflow channel in the antenna support structure that surrounds the hole.

5. The apparatus defined in claim 3, wherein a portion of the layer of adhesive is formed within the adhesive overflow channel surrounding the hole.

6. The apparatus defined in claim 1 further comprising antenna structures mounted on the antenna support structure.

7. The apparatus defined in claim 6, wherein the antenna structures comprise a printed circuit board mounted on the antenna support structure and patterned metal antenna traces on the printed circuit board.

8. The apparatus defined in claim 7, wherein the printed circuit board comprises a flexible printed circuit board.

9. The apparatus defined in claim 1 further comprising a layer of pressure sensitive adhesive that attaches the antenna support structure to the electronic device housing.

10. The apparatus defined in claim 1 wherein the electronic device housing comprises a metal housing.

11. The apparatus defined in claim 10 wherein the layer of adhesive comprises cured liquid adhesive.

12. The apparatus defined in claim 1, wherein the antenna support structure comprises a dielectric antenna support structure.

13. The apparatus defined in claim 12, wherein the dielectric antenna support structure comprises injection-molded plastic members.

14. The apparatus defined in claim 12, wherein the electronic device housing comprises a conductive electronic device housing and the dielectric antenna support structure is attached to the conductive electronic device housing using an additional layer of adhesive.

15. The apparatus defined in claim 12, wherein the dielectric antenna support structure comprises rib structures that separate a plurality of air-filled cavities within the dielectric antenna support structure.

16. The apparatus defined in claim 15, wherein the dielectric antenna support structure comprises a first hole formed between a first air-filled cavity of the plurality of air-filled cavities and the antenna window cap.

17. The apparatus defined in claim 16, wherein the dielectric antenna support structure further comprises a second hole formed between a second air-filled cavity of the plurality of air-filled cavities and the antenna window cap.

18. Apparatus, comprising:

a conductive electronic device housing;

a dielectric antenna window structure in the conductive housing;

an antenna support structure that is attached to the dielectric antenna window structure; and adhesive that attaches the antenna support structure to the conductive electronic device housing.

19. The apparatus defined in claim 18, further comprising:

an adhesive layer that attaches the antenna support structure to the dielectric antenna window structure.

20. The apparatus defined in claim 18, wherein the antenna support structure has opposing first and second sides, wherein the adhesive is formed between the first side and the conductive electronic device housing, the apparatus further comprising:

a printed circuit board mounted to the second side of the antenna support structure; and metal antenna traces on the printed circuit board.

21. The apparatus defined in claim 20, further comprising:

an adhesive layer formed between the first side of the antenna support structure and the dielectric antenna window structure.

22. The apparatus defined in claim 21, wherein the antenna support structure comprises at least one hole at the first side and an adhesive overflow channel surrounding the hole at the first side.

23. Apparatus, comprising:

a housing for an electronic device, wherein the housing has a hole;

a dielectric antenna window structure in the hole; and an antenna support structure that is attached to the housing and that is attached to the dielectric antenna window structure, wherein the antenna support structure is configured to fix a position of the dielectric antenna window structure relative to the housing.

24. The apparatus defined in claim 23, wherein the housing comprises a conductive housing structure and the antenna support structure comprises a dielectric antenna support structure, wherein the dielectric antenna support structure is attached to the conductive housing structure and the dielectric antenna window structure.

25. The apparatus defined in claim 24, wherein the dielectric antenna support structure is attached to the dielectric antenna window structure in the hole using a layer of adhesive.

26. The apparatus defined in claim 25, wherein the dielectric antenna support structure is attached to the conductive housing structure using an additional layer of adhesive.

27. The apparatus defined in claim 26, further comprising a printed circuit board mounted onto the dielectric antenna support structure and having patterned conductive antenna traces.

* * * * *